US006766028B1

(12) United States Patent
Dickens

(10) Patent No.: US 6,766,028 B1
(45) Date of Patent: Jul. 20, 2004

(54) HEADTRACKED PROCESSING FOR HEADTRACKED PLAYBACK OF AUDIO SIGNALS

(75) Inventor: Glenn Norman Dickens, Act (AU)

(73) Assignee: Lake Technology Limited, Ultimo (AU)

( * ) Notice: Subject to any disclaimer, the term of this patent is extended or adjusted under 35 U.S.C. 154(b) by 0 days.

(21) Appl. No.: 09/647,754

(22) PCT Filed: Mar. 31, 1999

(86) PCT No.: PCT/AU99/00242

§ 371 (c)(1),
(2), (4) Date: Jan. 16, 2001

(87) PCT Pub. No.: WO99/51063

PCT Pub. Date: Oct. 7, 1999

(30) Foreign Application Priority Data

Mar. 31, 1998 (AU) ..... PP 2715

(51) Int. Cl.[7] ..... H04R 5/02
(52) U.S. Cl. ..... 381/310; 381/74; 381/17
(58) Field of Search ..... 381/17, 18, 74, 381/310, 309, 1

(56) References Cited

U.S. PATENT DOCUMENTS 5,809,149 A 9/1998 Cashion et al.
5,822,438 A * 10/1998 Sekine et al. ..... 381/17

FOREIGN PATENT DOCUMENTS

| | | | |
|---|---|---|---|
| EP | 0 827 361 | A2 | 3/1998 |
| EP | 0932324 | A2 | 7/1999 |
| GB | 2340705 | A | 2/2000 |
| GB | 2339127 | A | 12/2000 |
| JP | 09093700 | A | 4/1997 |
| WO | PCT/US95/04839 | | 5/1995 |

OTHER PUBLICATIONS

Nick Flaherty, *3D Audio: New Directions in Rendering Realistic Sound*, Electronic Engineering, Apr., 1998, pp. 49–52.

Floyd E. Toole. *Two–Speaker Techniques for Three–Dimensional Sound*, Audio, Jun.,1997, pp. 34–39.

* cited by examiner

*Primary Examiner*—Melur Ramakrishnaiah
(74) *Attorney, Agent, or Firm*—Dov Rosenfeld; Inventek

(57) ABSTRACT

A method of simulating a spatial sound environment to a listener over headphones is disclosed comprising inputting a series of sound signals having spatial components; determining a current orientation of the headphones around the listener; determining a mapping function from a series of spatially static virtual speakers placed around the listener to each ear of the listener; utilising the current orientation to determine a current panning of the sound signals to the series of virtual speakers so as to produce a panned sound input signal for each of the virtual speakers; utilising the mapping function to map the panned sound input signal to each ear of the listener, and combining the mapped panned sound input signals to produce a left and right output signal for the headphones.

13 Claims, 4 Drawing Sheets

HEADTRACKED PROCESSING FOR HEADTRACKED PLAYBACK OF AUDIO SIGNALS

FIELD OF THE INVENTION

The present invention relates to the creation of spatialized sounds utilizing a headtracked set of headphones.

BACKGROUND OF THE INVENTION

Methods for localizing sounds utilizing headphones and a headtracking unit are known. For example, in U.S. patent Ser. No. 08/723,614 entitled "Methods and Apparatus for Processing Spatialized Audio", there is disclosed a system for virtual localization of a sound field around a listener utilizing a pair of headphones and a headtracking unit which determines the orientation of the headphones relative to an external environment. Unfortunately, the disclosed arrangement requires a high computational power or resource for real time rotation of a sound field environment so as to take into account any headphone movement relative to the desired sound field output.

Alternatively, without headtracking, a virtual speaker system over headphones can be simulated by using a pair of filters for each virtual sound source and then a post mixing of the results to produce left and right signals. For example, turning initially to FIG. 1, if it is desired to simulate to a user 1 over headphones eg. 2, 3 a virtual sound environment, with, for example, the environment comprising the popular Dolby DIGITAL (Trade Mark) environment which includes a left, 5, and right, 6 sound source in addition to a center cell source 7 and back left and right sound sources 8 and 9, then one form of suitable arrangement may be as illustrated 10 in FIG. 2. The arrangement 10 includes, for each channel eg. 11 providing a head related transfer function filter eg. 12, 13 for each input channel which maps the sound source to each of the left and right ears so as to form left and right headphone channels 16, 17. Similarly, each of the other channels is similarly processed and the output summed to each head channel. The arrangement 10 in FIG. 2 is provided for a system that does not utilize headtracking. The arrangement of FIG. 2 requires significant length filters eg. 12, 13 for each channel. Of course, many filter optimisations are possible in respect of the non treadtracked arrangement. An example of these optimisations include those disclosed in PCT Patent Application No. PCT AU99/00002 filed 6 Jan., 1999 by the present applicant entitled "Audio Signal Processing Method and Apparatus".

One possible method utilized by others to perform headtracking is to use an enormous amount of computational memory for storing a large number of sets of filter coefficients. For example, a set of filter coefficients could be stored for every angle around a listener (for full 360 coverage), then, each time the listener rotated their head the filter coefficients could be updated to reflect the new angle. A cross fade to the new filter coefficients would remove any unwanted artefacts. This technique has the significant disadvantage that it requires an enormous amount of memory to store the large number of filtered coefficients.

An alternative technique is disclosed in U.S. Pat. No. 5,659,619 by Abel which utilizes a process of principle component analysis where the head related transfer function is assumed to consist of several individual filter structures which are all modified from a look-up table according to a current head angle. This method provides for a reduction in memory requirements.

However, it is only practical for short filters (short HRTF length) which provide for directionality of a sound source and it is not practical for a full room reverberant response in addition to the effective simulation of a full room.

It would be desirable to provide for a more efficient form of simulation of a sound surround environment over headtracked headphones in addition to the effective simulation of a full room reverberant response.

SUMMARY OF THE INVENTION

It is an object of the present invention to provide for a more efficient form of simulation of a surround sound environment over headtracked headphones.

In accordance with a first aspect of the present invention, there is provided a method of simulating a spatial sound environment to a listener over headphones comprising inputting a series of sound signals having spatial components; determining a current orientation of the headphones around the listener; determining a mapping function from a series of spatially static virtual speakers placed around the listener to each ear of the listener; utilising the current orientation to determine a current panning of the sound signals to the series of virtual speakers so as to produce a panned sound input signal for each of the virtual speakers; utilising the mapping function to map the panned sound input signal to each ear of the listener; and combining the mapped panned sound input signals to produce a left and right output signal for the headphones.

Preferably, the virtual speakers include a set of simulated speakers placed at substantially equal angles around the listener which can be placed substantially in a horizontal plane around a listener or placed so as to fully surround a listener in three dimensions. The present invention has particular application wherein the series of sound signals comprise a Dolby DIGITAL encoding of a sound environment.

In accordance with a second aspect of the present invention, there is provided an apparatus for simulating a spatial sound environment to a listener over headphones comprising input means for inputting a series of signals comprising a spatial sound environment; panning means for panning the series of signals amongst a predetermined number of virtual output signals to produce a plurality of virtual output speakers signals; head related transfer function mapping means for mapping the virtual output speaker signals to left and right headphone channel signals; and combining means for combining each of the left and right headphone channel signals into combined left and right headphone signals for playback over the headphones.

Preferably, the panning means, the head related transfer function mapping means and the combining means are implemented in the form of a suitably programmed digital signal processor.

BRIEF DESCRIPTION OF THE DRAWINGS

Notwithstanding any other forms which may fall within the scope of the present invention, preferred forms of the invention will now be described, by way of example only, with reference to the accompanying drawings in which.

DESCRIPTION OF PREFERRED AND OTHER EMBODIMENTS

In the preferred embodiment, a fixed filter and coefficient structure is utilized to simulate a stationary virtual speaker array and then a speaker panner is utilized to position the virtual sound sources at desired positions. The preferred embodiment will be discussed with reference to a Surround Sound implementation of the popular Dolby DIGITAL format.

Figure 1:
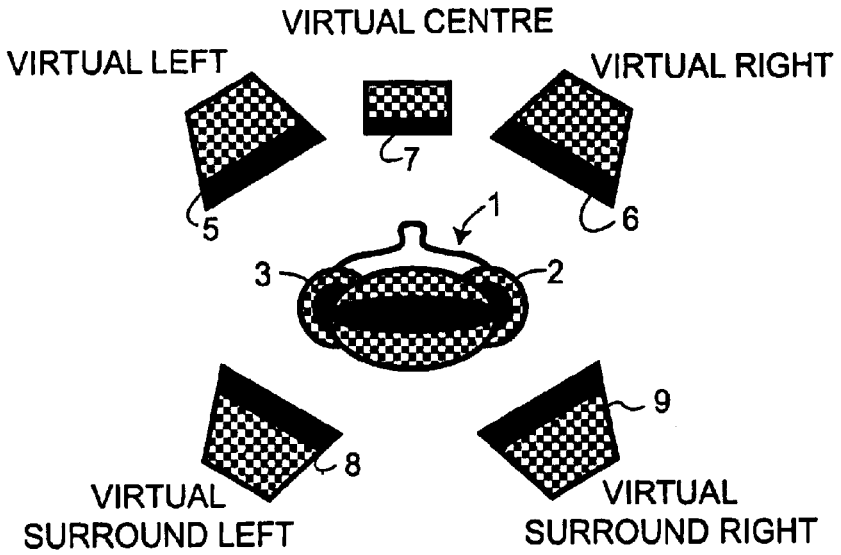
FIG. 1 illustrates the concept of a surround sound system.
Figure 2:
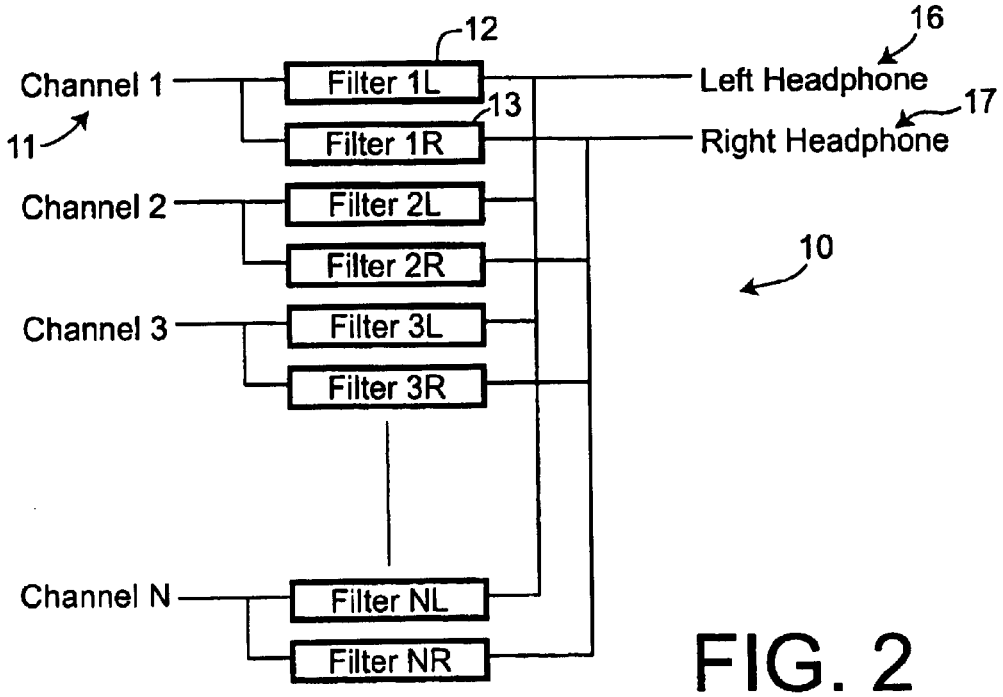
FIG. 2 illustrates a prior art arrangement for creating a surround sound environment over headphones.
Figure 3:
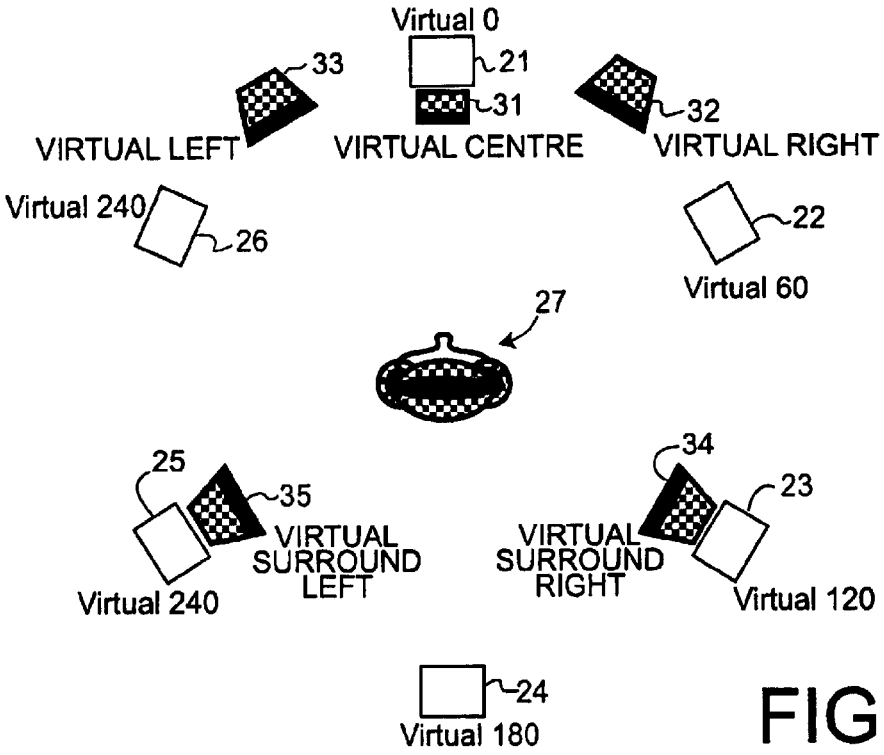
FIG. 3 illustrates the utilization of a virtual speaker system in accordance with the preferred embodiment.

Turning to FIG. 3, there is illustrated a method of the preferred embodiment. The method of the preferred. embodiment comprises utilizing a set of virtual speakers 21–26 arranged around a listener 27. A head related transfer function to each ear of the listener 27 is calculated for each of the virtual speakers 21–26 arranged around a listener 27. The techniques utilized can be substantially the same as those described previously with reference to FIG. 2 and known in the prior art.

A series of virtual surround sound speakers 31–35 are then utilized having a stable external reference frame relative to the user 27. Hence, as the user 27 turns their head, the virtual speaker 32 for example is panned between speakers 21–22 so as to locate the speaker 32 at the requisite point between speakers 21 and 22. Similar panning occurs for each of the other virtual surround sound speakers 32–35. Hence, each of the surround sound channel sources eg. 32 is panned between speakers so as to provide for the directionality of each sound source. The directionality of each sound source can be updated depending on the rotation of a listener's head and the speaker panning technique can be totally flexible and compatible with prior art panning techniques for conventional loudspeakers.

Figure 4:
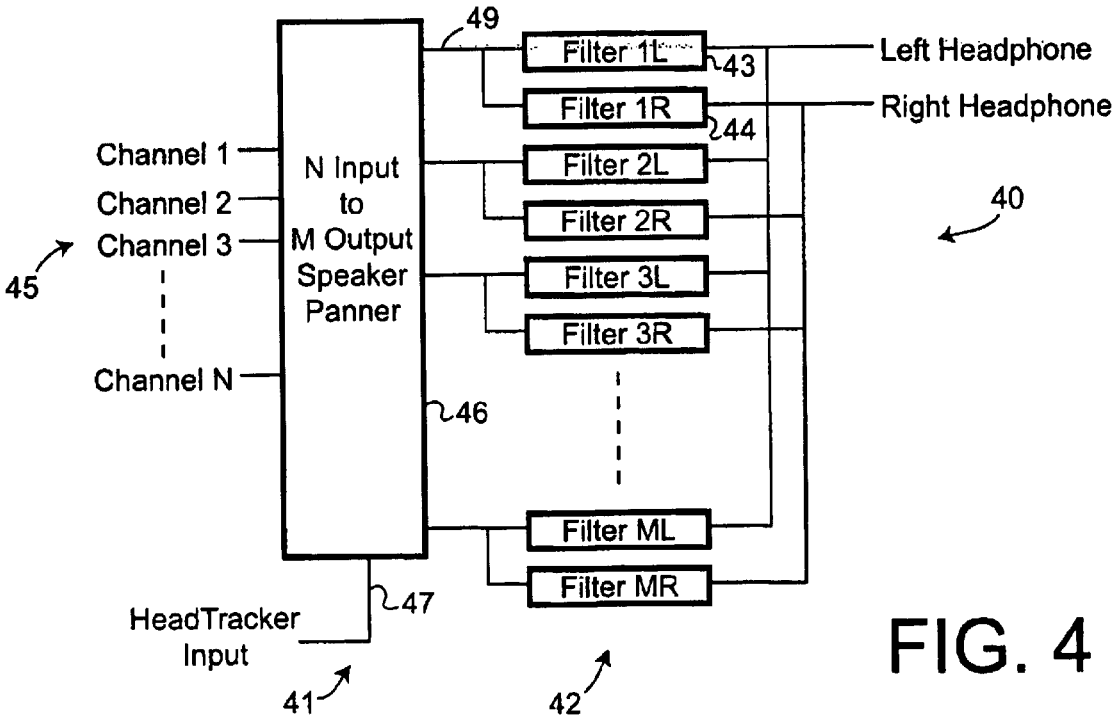
FIG. 4 is a schematic block diagram of the structure of the preferred embodiment.

Turning now to FIG. 4, there is illustrated one form of arrangement of the preferred embodiment 40. The preferred embodiment is based around two parts including a speaker panning section 41 and HRTF section 42. The HRTF section 42 includes the usual series of filters eg. 43, 44 which map each of the virtual speakers 21–26 to the left and right ear of the listener 27. The filter coefficients being substantially static.

The input channels for each of the surround sound sources 31–35 are input to an N input to M output speaker panner 46. The speaker panner 46 also having as an input 47 the headtracking input signal from a listener's headphone. The speaker panner 46 can then be set to provide panning between the virtual output speakers 21–26 which are output eg. 49.

Figure 5:
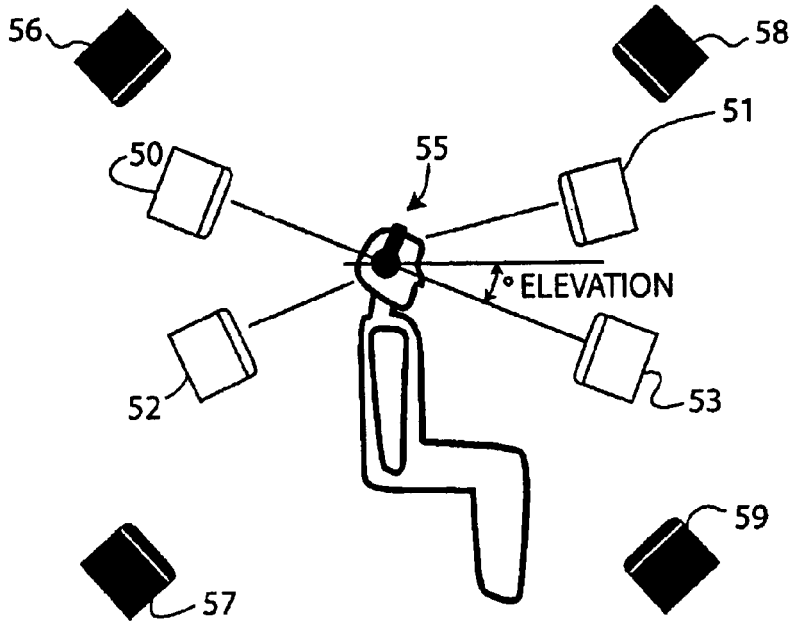
FIGS. 5 and 6 illustrate the extension of the preferred embodiment to three dimensions.
Figure 6:
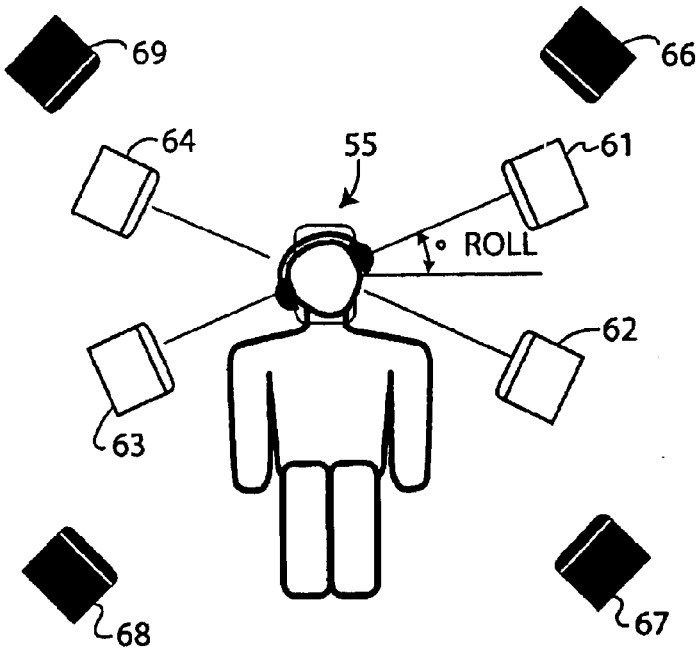

The technique of the preferred embodiment can be extended to provide for headtracking of elevation and roll of a user's head position where such information is available from the headtracking unit. This can be achieved by extending the location of the stationary virtual speakers to be in a three-dimensional cube around a listener. For example, if eight virtual speakers are simulated representing the eight corners of a cube around a listener, then any panning system can also compensate for head movements around a Y and Z plane. Hence, in addition to yaw, elevation and roll can also be taken into account. Of course, the more virtual speakers utilized to create the virtual speaker space around a listener, the better the accuracy of the system. Once again, panning can be provided by means of a front end system that utilizes the headtracked yaw, elevation and roll position to determine the panning effect between speakers. For example, as illustrated in FIG. 5, the elevation of a listener 55 can be determined via a standard headtracking unit and utilized to pan three-dimensional sound sources 56–59 around speakers 50–53 in accordance with the requirements. Similarly, as illustrated in FIG. 6, the roll of a user's head 55 can be utilized for panning the virtual sound sources 66–69 between virtual speakers 61–64 again as a pre-processing step.

Figure 7:
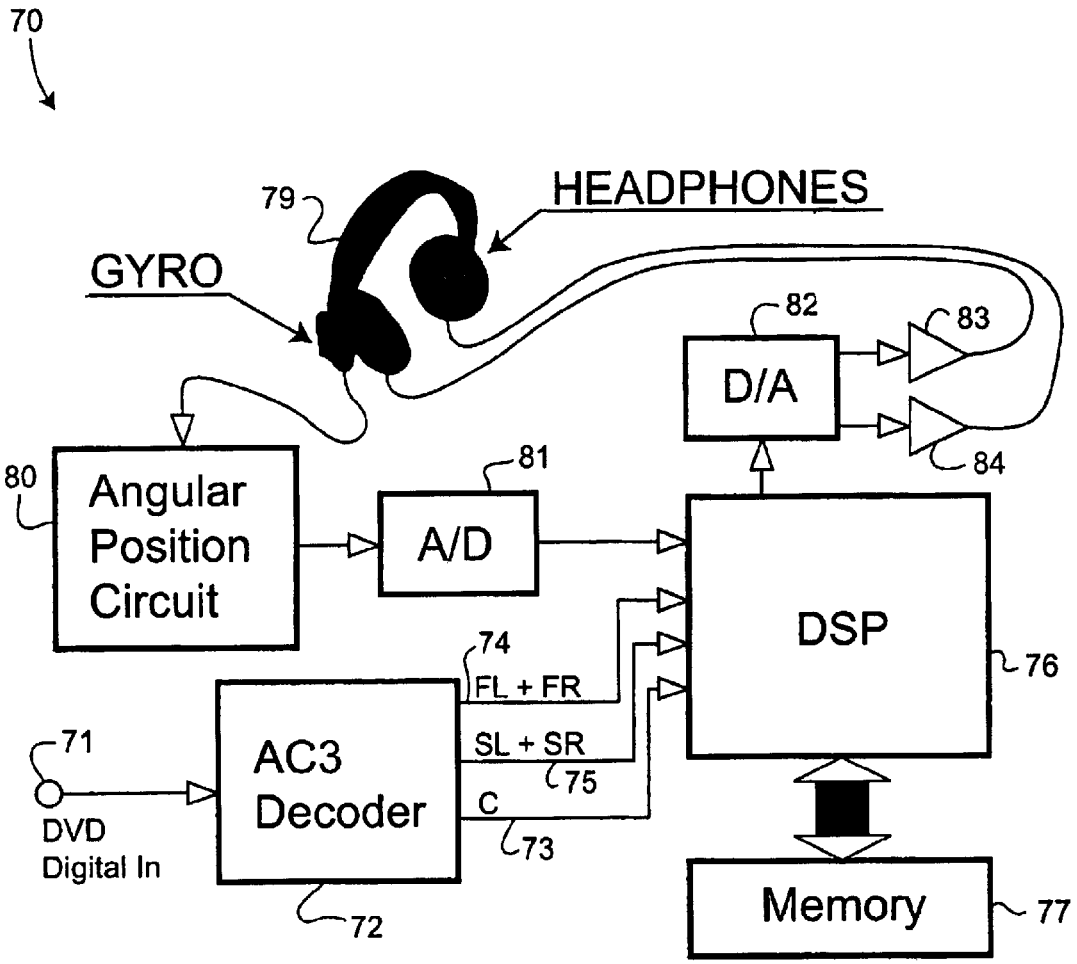
FIG. 7 illustrates one form of implementation of the preferred embodiment.

Turning now to FIG. 7, there is illustrated an example system 70 for implementation of the preferred embodiment. The system 70 includes a standard DVD digital input source 71 which is fed to an DIGITAL decoder 72 which again can be standard. The DIGITAL decoder outputs center channel 73, front left and right channels 74, and surround or back left and right channels 75. The outputs 73–75 are fed to a DSP processing board 76 which operates with an attached memory 77. One form of suitable DSP processing board can be the Motorola 56002 EVM evaluation board card designed to be inserted into a PC type computer and directly programmed therefrom and having suitable Analogue/Digital and Digital/Analogue converters.

A set of headphones 79 are provided which include headtracking capabilities in the form of an angular position circuit 80. The angular position circuit 80 determines the yaw, elevation and roll and can comprise a Polhemus 3 space Insidetrak Tracking system available from Polhemus, 1 Hercules Drive, PO Box 560, Colchester, Vt. 05446, USA. The output from the angular position circuit 80 is converted to a digital form 81 for inputting to DSP chip 76. The DSP chip 76 is responsible for implementing the core functionality of FIG. 4, outputting two digital channels to digital to analogue converter 82 which in turn outputs analogue left and the right headphone speaker channel data which can be amplified 83, 84 in accordance with the requirements. The DSP chip 76 also implements the speaker panner mixing which pans the input sources 73–75 according to the input angular position. Further, a filter array is provided within the DSP 76 which simulates the virtual speaker array of six speakers in accordance with the previously known prior art techniques.

It would be therefore evident that the preferred embodiment provides for a simplified form of providing for full surround sound capabilities of the headtracked headphones in the presence of movement of the listener's head.

It would be appreciated by a person skilled in the art that numerous variations and/or modifications may be made to the present invention as shown in the specific embodiment without departing from the spirit or scope of the invention as broadly described. The present embodiment is, therefore, to be considered in all respects to be illustrative and not restrictive.

I claim:

1. A method of simulating a spatial sound environment to a listener over headphones comprising:

inputting a series of sound signals having spatial components;

determining a current orientation of said headphones around said listener;

determining a mapping function from a series of spatially static virtual speakers placed around the listener to each ear of the listener;

utilising said current orientation to determine a current panning of said sound signals to said series of virtual speakers so as to produce a panned sound input signal for each of said virtual speakers;

utilising said mapping function to map said panned sound input signal to each ear of said listener; and combining said mapped panned sound input signals to produce a left and right output signal for said headphones.

2. A method as claimed in claim 1 wherein said virtual speakers include a set of simulated speakers placed at substantially equal angles around said listener.

3. A method as claimed in claim 1 wherein said virtual speakers are substantially in a horizontal plane around a listener.

4. A method as claimed in claim 1 wherein said virtual speakers are placed so as to fully surround a listener in three dimensions.

5. A method as claimed in claim 1 wherein said series of sound signals comprise a Dolby DIGITAL encoding of a sound environment.

6. An apparatus for simulating a spatial sound environment to a listener over headphones comprising:

input means for inputting a series of signals comprising a spatial sound environment for listening in a first reference frame;

panning means for panning said series of signals amongst a predetermined number of virtual output signals to produce a plurality of panned virtual output speakers signals in a second reference frame that is fixed relative to the orientation of said headphones, said panning means accepting a signal indicative of the orientation of said headphones to said first reference fame;

head related transfer function mapping means for mapping said panned virtual output speaker signals to left and right headphone channel signals; and combining means for combining each of said left and right headphone channel signals into combined left and right headphone signals for playback over said headphones, such that the head related transfer function mapping means and the means for combining need not vary for different orientations of said headphones to said first reference frame.

7. An apparatus as claimed in claim 6 wherein said panning means, said head related transfer function mapping means and said combining means are implemented in the form of a suitably programmed digital signal processor.

8. An apparatus for simulating a spatial sound environment to a listener over headphones comprising:

an input device adapted to input a series of signals comprising a spatial sound environment for listening in a first reference frame;

a panning module adapted to pan said series of signals amongst a predetermined number of virtual output signals to produce a plurality of panned virtual output speakers signals in a second reference frame that is fixed relative to the orientation of said headphones, said panning module accenting a signal indicative of the orientation of said headphones to said first reference frame;

a head related transfer output mapping module adapted to map said panned virtual output speaker signals to left and right headphone channel signals; and a combining module adapted to combine each of said left and right headphone channel signals into combined left and right headphone signals for playback over said headphones, such that the head related transfer function mapping module and the combining module need not vary for different orientations of said headphones to said first reference fame.

9. An apparatus as claimed in claim 8, wherein said panning module, said head related transfer function mapping module and said combining module are implemented in the form of a suitable programmed digital signal processor.

10. An apparatus as claimed in claim 8, wherein said virtual output speaker signals correspond to virtual speakers which include a set of simulated speakers placed at substantially equal angles around said listener.

11. An apparatus claimed in claim 10, wherein said virtual speakers are substantially in a horizontal plane around a listener.

12. An apparatus as claimed in claim 10, wherein said virtual speakers are placed so as to fully surround a listener in three dimensions.

13. A method as claimed in claim 8, wherein said series of signals comprise a Dolby DIGITAL encoding of a sound environment.

* * * * *

UNITED STATES PATENT AND TRADEMARK OFFICE

CERTIFICATE OF CORRECTION

PATENT NO. : 6,766,028 B1
DATED : July 20, 2004
INVENTOR(S) : Dickins

It is certified that error appears in the above-identified patent and that said Letters Patent is hereby corrected as shown below:

Column 6,
Line 11, please change "accenting a signal" to -- accepting a signal --.

Signed and Sealed this

Thirty-first Day of August, 2004

JON W. DUDAS
*Director of the United States Patent and Trademark Office*

UNITED STATES PATENT AND TRADEMARK OFFICE

CERTIFICATE OF CORRECTION

PATENT NO. : 6,766,028 B1
DATED : July 20, 2004
INVENTOR(S) : Dickins

It is certified that error appears in the above-identified patent and that said Letters Patent is hereby corrected as shown below:

Column 6,
Line 41, change "A method" to -- An apparatus --.

Signed and Sealed this

Twenty-eighth Day of September, 2004

JON W. DUDAS
*Director of the United States Patent and Trademark Office*